US006670927B2

(12) United States Patent
Ro

(10) Patent No.: US 6,670,927 B2
(45) Date of Patent: Dec. 30, 2003

(54) VEHICULAR GLASS ANTENNA

(75) Inventor: Kyu-Sang Ro, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/134,846

(22) Filed: Apr. 24, 2002

(65) Prior Publication Data

US 2003/0043082 A1 Mar. 6, 2003

(30) Foreign Application Priority Data

Aug. 28, 2001 (KR) ..... 2001-52013

(51) Int. Cl.[7] ..... H01Q 1/32
(52) U.S. Cl. ..... 343/713; 343/711
(58) Field of Search ..... 343/711, 712, 343/713, 705, 708, 704, 700 MS

(56) References Cited

U.S. PATENT DOCUMENTS

| | | | | |
|---|---|---|---|---|
| 4,823,140 A | * | 4/1989 | Shibata et al. | 343/713 |
| 5,005,020 A | * | 4/1991 | Ogawa et al. | 343/713 |
| 5,307,076 A | | 4/1994 | Murakami et al. | 343/704 |
| 5,364,487 A | * | 11/1994 | Friske et al. | 156/309.9 |
| 5,528,314 A | | 6/1996 | Nagy et al. | 343/713 |
| 5,670,966 A | | 9/1997 | Dishart et al. | 343/713 |
| 5,714,959 A | | 2/1998 | Troy et al. | 343/713 |
| 5,792,298 A | | 8/1998 | Sauer et al. | 156/230 |
| 6,020,855 A | | 2/2000 | Nagy et al. | 343/713 |
| 6,275,157 B1 | | 8/2001 | Mays et al. | 340/572.5 |

* cited by examiner

*Primary Examiner*—James Clinger
(74) *Attorney, Agent, or Firm*—Pennie & Edmonds LLP

(57) ABSTRACT

A vehicular glass antenna wherein the antenna is formed of transparent material and is mounted at a front windshield glass where receptive performance of broadcasting signals is best without obstructing a driver's view.

6 Claims, 2 Drawing Sheets

VEHICULAR GLASS ANTENNA

FIELD OF THE INVENTION

The present invention relates to a vehicular glass antenna, and more particularly to a vehicular glass antenna adapted to be installed in a front windshield glass without obstructing the view of the driver.

BACKGROUND OF THE INVENTION

In general, antennas for receiving radio broadcasts can be classified into two kinds: one is a pole antenna located on an exterior panel of the vehicle body and the other is a glass antenna integrally mounted in a window glass. When an antenna embodied by conductor line is installed at a front windshield glass, the view of a driver is obstructed. It is prohibited by law to mount an antenna thusly in the front windshield glass, such that the antenna is commonly set in a rear windshield glass.

However, there is a problem in the conventional vehicular glass antenna thus described in that an antenna is installed at a place where reception of broadcast signals are relatively inferior as compared to the front windshield glass, thus decreasing performance of radio reception.

SUMMARY OF THE INVENTION

The present invention provides a vehicular glass antenna adapted to be installed in a front windshield glass which is the most suitable place for receiving signals from broadcast stations without obstructing the view of a driver. In accordance with one embodiment of the present invention, there is provided a vehicular glass antenna, the antenna formed at a front windshield glass with at least more than one antenna pattern made of transparent material.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
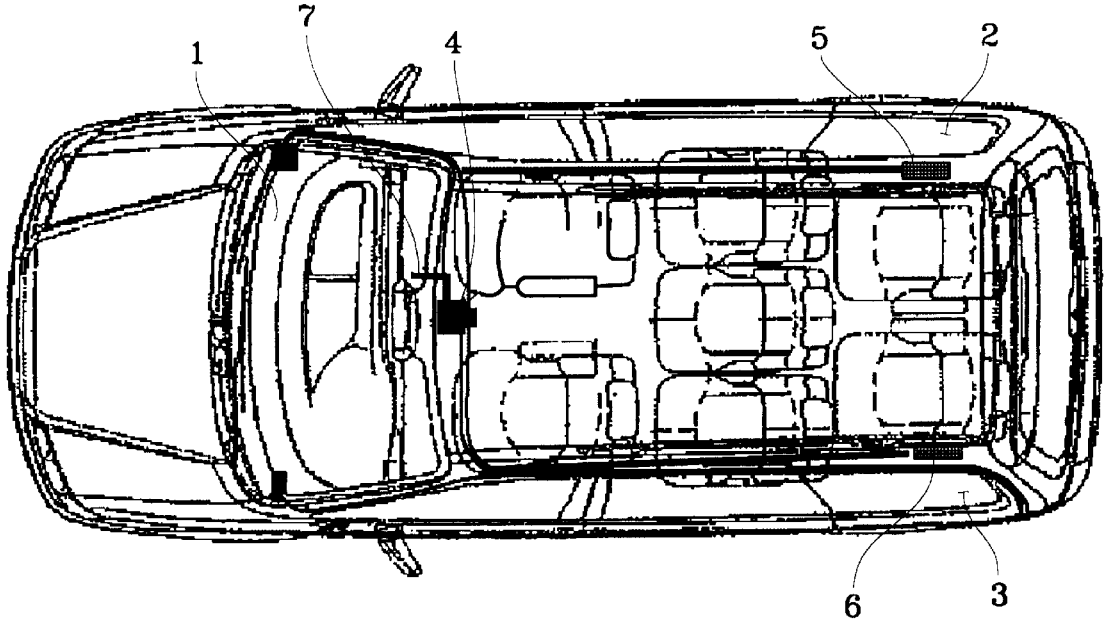
FIG. 1 is a top view of a vehicle with a vehicular audio system equipped with a vehicular glass antenna according to the present invention.

As shown in FIG. 1, a front windshield glass 1 is formed with two antenna patterns (not visible) while rear side glasses 2 and 3 are respectively installed with one antenna pattern (not visible). The front windshield glass 1 is also formed at a neighboring position thereof with a diversity reception module 4. The rear side glasses 2 and 3 are mounted at neighboring positions thereof with amplifying modules 5 and 6 for amplifying radio broadcasting signals received from the antenna pattern formed at the rear side glasses 2 and 3 to input same to the diversity reception module 4.

The diversity reception module 4 serves to measure strength and weakness of radio broadcasting signals received through the antenna patterns respectively formed at the rear side glasses 2 and 3 and the two antenna patterns formed at the front windshield glass 1. Diversity reception module 4 selects the strongest broadcast signal and inputs same to an audio component through an audio input terminal 7.

Figure 2:
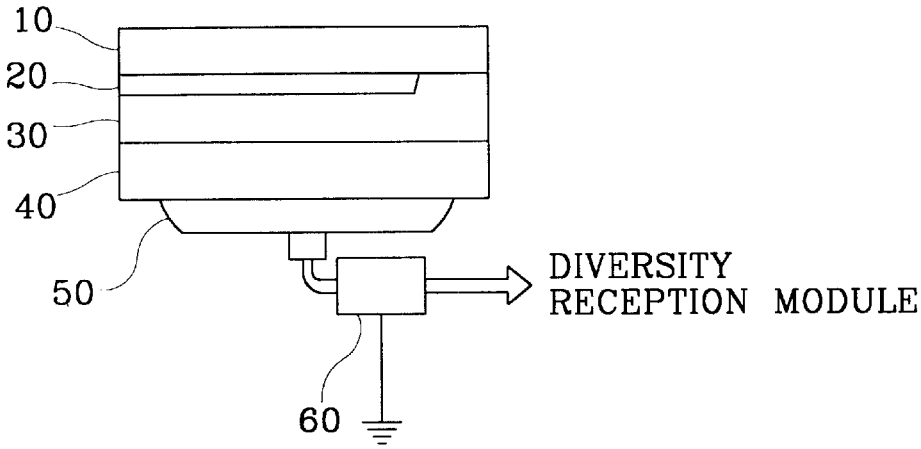
FIG. 2 is a schematic cross-sectional view of a vehicular glass antenna according to the present invention.

As shown in FIG. 2, antenna pattern 20 is formed by being coated on an inner side of an external glass 10. Pattern 20 is attached by being overlaid with a polyvinyl butyral (PVB) film 30, and the PVB film 30 is attached by being overlaid with inner glass 40. Inner glass 40 is attachably formed with a capacitive connector 50, which in turn receives the signal collected by the antenna pattern 20 to transmit same to the diversity reception module 4 through a coaxial cable 60.

Figure 3:
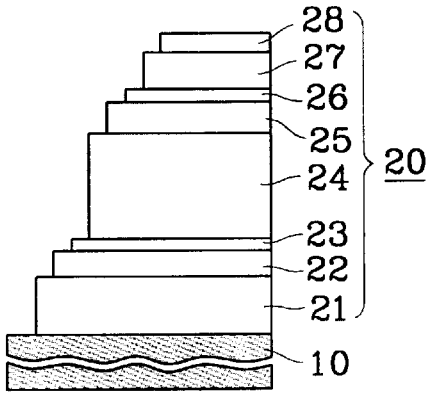
FIG. 3 is a cross-sectional view of an antenna pattern according to the present invention.

The antenna pattern 20, being formed at a front windshield glass, is embodied in transparent material in order not to obstruct a driver's view. As illustrated in FIG. 3, a surface of an external glass 10, having a predetermined thickness (for example about 2.3 mm), is coated with a predetermined thickness (for example about 0.029–0.031 $\mu$m) of $Zn_2SnO_4$ 21. The $Zn_2SnO_4$ layer 21 is coated thereon with a gold layer 22 at a predetermined thickness (for example 0.009–0.011 $\mu$m), on which a predetermined thickness (for example 0.0049–0.0051 $\mu$m), of zirconium is again coated.

Furthermore, zirconium layer 23 is coated thereon with a predetermined thickness (for example about 0.05–0.06 $\mu$m) of $Zn_2SnO_4$ 24, on which another gold layer 25 is coated at a predetermined thickness (for example about 0.014–0.015 $\mu$m). Successively, gold layer 25 is coated thereon with another zirconium layer 26 of a predetermined thickness (for example about 0.0045–0.005 $\mu$m). Still furthermore, zirconium layer 26 is coated thereon with another $Zn_2SnO_4$ layer 27 and a $ZrO_2$ layer 28, respectively, each at a predetermined thickness (for example about 0.018–0.02 $\mu$m, 0.006–0.007 $\mu$m) to complete an antenna pattern.

In the vehicular glass antenna thus constructed according to the present invention, diversity reception module 4 receives radio broadcast signals respectively input from four antenna patterns, including two antenna patterns formed at the front windshield glass 1 and two antenna patterns respectively formed at the rear side glasses 2 and 3 to select the strongest radio signal out of the received signals and to output same to an audio component via the audio input terminal 7 in order to improve radio signal reception capabilities.

Furthermore, antenna patterns are installed at the front windshield glass where receptive capability of radio signals are very good to thereby increase reception performance. Still furthermore, the antenna patterns are made of transparent materials to allow a driver's view to be free from obstruction.

According to a preferred embodiment of the invention the antenna patterns are made of fully transparent materials, but as long as a driver's view is not disturbed, the materials need not be of completely pellucid material. Transparency sufficient not to interrupt a driver's view during vehicle operation is acceptable.

As apparent from the foregoing, there is an advantage in the vehicular glass antenna thus described according to the present invention in that antenna is mounted at a front windshield glass where reception performance of broadcasting signals is best without obstructing a driver's view.

What is claimed is:

1. A vehicular glass antenna, configured to be formed in a front windshield glass, comprising at least one antenna pattern made of transparent material, wherein the antenna pattern is sequentially layered, comprising a first $Zn_2SnO_4$ layer, a first Au layer, a first Zr layer, a second $Zn_2SnO_4$ layer, a second Au layer, a second Zr layer, a third $Zn_2SnO_4$ layer and a $ZrO_2$ layer.

2. The antenna as defined in claim 1, further comprising at least two antenna patterns formed in the front windshield glass.

3. The antenna as defined in claim 2, further comprising antenna patterns of transparent materials formed in a rear side glass.

4. The antenna as defined in claim 2 or 3, wherein the antenna pattern is coated on an inner side of an external glass layer with the antenna pattern adhered thereto by organic adhesive film and with an inner glass layer overlaying both.

5. A vehicular glass antenna system, comprising:

antenna patterns of transparent materials each formed in a front windshield glass and rear side glass, wherein the antenna patterns are sequentially layered, comprising a first $Zn_2SnO_4$ layer, a first Au layer, a first Zr layer, a second $Zn_2SnO_4$ layer, a second Au layer, a second Zr layer, a third $Zn_2SnO_4$ layer and a $ZrO_2$ layer;

a diversity reception module for selectively outputting the strongest broadcasting signal out of broadcasting signals received by the plurality of antenna patterns; and an audio component for reproducing the broadcasting signal selectively output from the diversity reception module for a driver or passengers to listen thereto.

6. The antenna as defined in claim 5, wherein the antenna patterns are coated on an inner side of an external glass layer while the antenna patterns are adhered at one side thereof by organic adhesive film and an inner glass layer in regular sequence.

* * * * *